US011002449B2

(12) United States Patent
Chen

(10) Patent No.: US 11,002,449 B2
(45) Date of Patent: May 11, 2021

(54) SMOKELESS SAFE COMBUSTION DEVICE

(71) Applicant: Pro-Iroda Industries, Inc., Taichung (TW)

(72) Inventor: Wei-Long Chen, Taichung (TW)

(73) Assignee: Pro-Iroda Industries, Inc., Taichung (TW)

( * ) Notice: Subject to any disclaimer, the term of this patent is extended or adjusted under 35 U.S.C. 154(b) by 205 days.

(21) Appl. No.: 15/709,625

(22) Filed: Sep. 20, 2017

(65) Prior Publication Data

US 2019/0086095 A1 Mar. 21, 2019

(51) Int. Cl.

| | |
|---|---|
| ***F24C 5/04*** | (2006.01) |
| ***F24C 15/32*** | (2006.01) |
| ***F23D 3/18*** | (2006.01) |
| ***F23D 3/22*** | (2006.01) |
| ***F24C 5/02*** | (2006.01) |

(52) U.S. Cl.

CPC ..... *F24C 5/04* (2013.01); *F23D 3/18* (2013.01); *F23D 3/22* (2013.01); *F24C 15/32* (2013.01)

(58) Field of Classification Search

CPC ..... F24C 5/04; F24C 15/32; F24C 15/2007; F24C 5/02; F23D 3/18; F23D 3/22; Y10S 55/36; H05B 6/6423; F24B 7/005

USPC ..... 126/96, 500, 523, 512, 526, 529, 530, 126/533, 550; 431/298, 320, 321, 314, 431/300, 311

See application file for complete search history.

(56) References Cited

U.S. PATENT DOCUMENTS

| | | | | | |
|---|---|---|---|---|---|
| 422,758 | A * | 3/1890 | Finch | F24C 5/06 | 126/45 |
| 1,945,966 | A * | 2/1934 | Brackett | F24B 7/02 | 126/96 |
| 4,240,403 | A * | 12/1980 | Bader | F24B 5/023 | 126/197 |
| 4,254,756 | A * | 3/1981 | Wells | F24B 1/1902 | 126/518 |
| 4,469,083 | A * | 9/1984 | Helle | F24B 5/026 | 126/200 |
| 4,574,773 | A * | 3/1986 | Moughamian | F24B 1/192 | 126/531 |

(Continued)

FOREIGN PATENT DOCUMENTS

| | | |
|---|---|---|
| CN | 201281376 Y | 7/2009 |
| CN | 201416914 Y | 3/2010 |

(Continued)

*Primary Examiner* — Edelmira Bosques
*Assistant Examiner* — Christopher Matthew Odell
(74) *Attorney, Agent, or Firm* — Alan D. Kamrath; Karin L. Williams; Mayer & Williams PC

(57) ABSTRACT

A combustion device includes a stove body and a flow guiding device. The stove body has first and second sides disposed oppositely and includes a wick disposed between the first and second sides. The wick is spaced from the first and second sides at first and second distances respectively. A flow guiding device includes first and second shielding members respectively connected to the first and second sides of the stove body. The wick is spaced from the first and second shielding members at third and fourth distances respectively. The third distance is greater than the first distance and the first shielding member is spaced from the first side. The fourth distance is greater than the second distance and the second shielding member is spaced from the second outer side.

11 Claims, 7 Drawing Sheets

(56) References Cited

U.S. PATENT DOCUMENTS

| | | | | | |
|---|---|---|---|---|---|
| 4,611,572 | A * | 9/1986 | Martenson | F24B 5/02 | 126/60 |
| 4,834,064 | A * | 5/1989 | Takashinna | F24C 1/14 | 126/512 |
| 5,014,683 | A * | 5/1991 | Wilkening | F24B 1/19 | 126/163 A |
| 5,038,754 | A * | 8/1991 | Scala | F24B 1/1888 | 126/521 |
| 5,388,566 | A * | 2/1995 | Smith | F24B 1/1808 | 126/307 A |
| 5,701,882 | A * | 12/1997 | Champion | F24B 1/181 | 126/523 |
| 8,464,704 | B2 | 6/2013 | Brown | | |
| 9,500,373 | B2 | 11/2016 | Gabel et al. | | |
| 9,651,246 | B2 | 5/2017 | Chen | | |
| 9,816,701 | B2 | 11/2017 | Chen | | |
| 2005/0011512 | A1* | 1/2005 | Bachinski | F24B 1/185 | 126/521 |
| 2006/0188831 | A1 | 8/2006 | Hess et al. | | |
| 2009/0151711 | A1* | 6/2009 | Wells | F24B 7/025 | 126/523 |
| 2014/0162202 | A1* | 6/2014 | Chen | F23D 3/22 | 431/323 |
| 2016/0047552 | A1 | 2/2016 | Chae | | |
| 2016/0061456 | A1* | 3/2016 | Jang | F24C 5/04 | 126/49 |
| 2017/0009998 | A1 | 1/2017 | Yeh et al. | | |

FOREIGN PATENT DOCUMENTS

| | | | | |
|---|---|---|---|---|
| CN | 202153026 U | 2/2012 | | |
| CN | 106352326 A | 1/2017 | | |
| GB | 292653 A * | 6/1928 | F24C 15/32 | |

* cited by examiner

SMOKELESS SAFE COMBUSTION DEVICE

BACKGROUND OF THE INVENTION

1. Field of the Invention

The present invention relates to a safe combustion device and, particularly, to a safe combustion device designed to be safer.

2. Description of the Related Art

Conventional fireplaces can be decorative and create a pleasant atmosphere. However, a smoking problem is a common occurrence and soot is also a problem. In contrast, a fireplace including a chimney can allow heat of combustion to send waste gases up and draw outside air toward the fireplace. Thus, a natural convection occurs. Thus, the chimney allows the fireplace to achieve a longer burn time and to provide a larger amount of heat.

In recent years, a direct vent fireplace has been invented and has become popular for the use of large fireplaces. The fireplace has an inlet and outlet disposed outside of the room.

Furthermore, for apartments and places where there is no room for a fixed heating conditioner, fireplaces without a chimney are becoming popular. The fireplaces without chimneys generally use gas or biofuel as fuel. The biofuel fireplaces obtain praise from customers because they are inexpensive and easily installed. In addition, it is convenient to buy biofuel. Environmental protection is considered as a factor too. The biofuel fireplaces appearing recently, including ones for indoor use, ones for outdoor use, and ones that are portable, are generally greater in size and can produce greater combustion. However, they often become hot during operation due to heat dissipation, and heat on a viewing glass can be hot enough to burn the user. Further, hot air will move up and circulate surrounding air. Thus, a natural convection occurs. In this regard, most heat is transferred and flows in a direction toward an upper end of the flame via convection, while little heat is transferred to a lower end and lateral sides of the flame via radiation and conduction. Thus, the amount of heat flowing to sides of the fireplaces is relatively small, thereby resulting in a short heating distance and low heating efficiency. However, heat going upward for a long period of time can cause damage to the ceiling of a room. Another problem is that heat is not evenly distributed in the room, which can affect the ability of the conditioner to control the temperature of the room accurately.

The present invention is, therefore, intended to obviate or at least alleviate the problems encountered in the prior art.

SUMMARY OF THE INVENTION

According to the present invention, a smokeless safe combustion device includes a stove body and a flow guiding device. The stove body has opposite first and second sides and includes a wick disposed between the first and second sides. The wick is spaced from the first and second sides at first and second distances respectively. The flow guiding device includes a first and second shielding member respectively connected to the first and second sides of the stove body. The wick is spaced from the first and second shielding members at third and fourth distances respectively. The third distance is greater than the first distance and the first shielding member is spaced from the first side. The fourth distance is greater than the second distance and the second shielding member is spaced from the second side.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the public generally, and especially the scientists, engineers and practitioners in the art who are not familiar with patent or legal terms or phraseology, to determine quickly from a cursory inspection the nature and essence of the technical disclosure. The abstract is neither intended to define the invention, which is measured by the claims, nor is it intended to be limiting as to the scope of the invention in any way.

It is therefore an objective of the present invention to provide a smokeless safe combustion device that radiates heat effectively.

Other objectives, advantages, and new features of the present invention will become apparent from the following detailed description of the invention when considered in conjunction with the accompanied drawings.

DETAILED DESCRIPTION OF THE INVENTION

Figure 1:
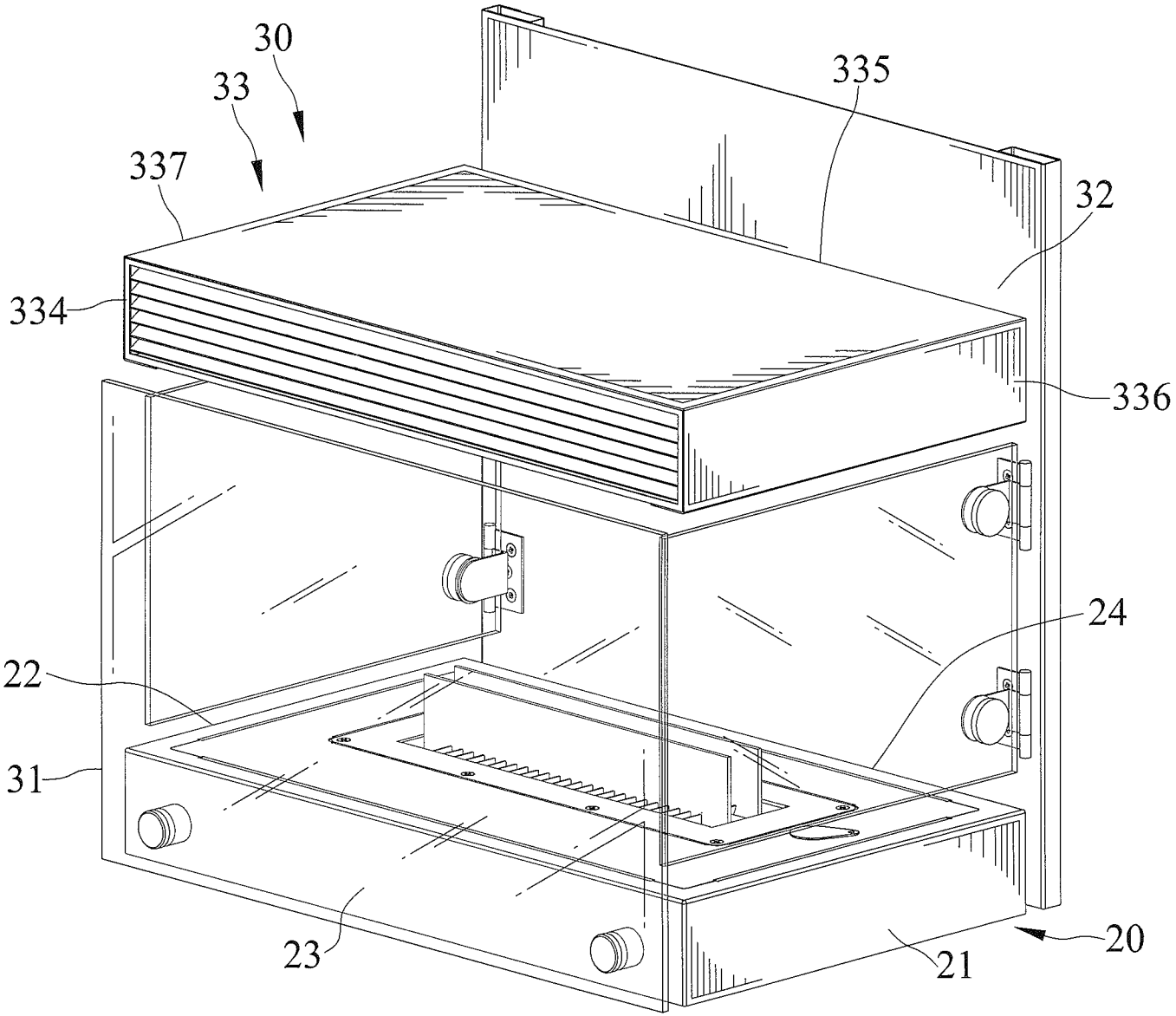
FIG. 1 is a perspective view of a smokeless safe combustion device in accordance with the present invention.
Figure 2:
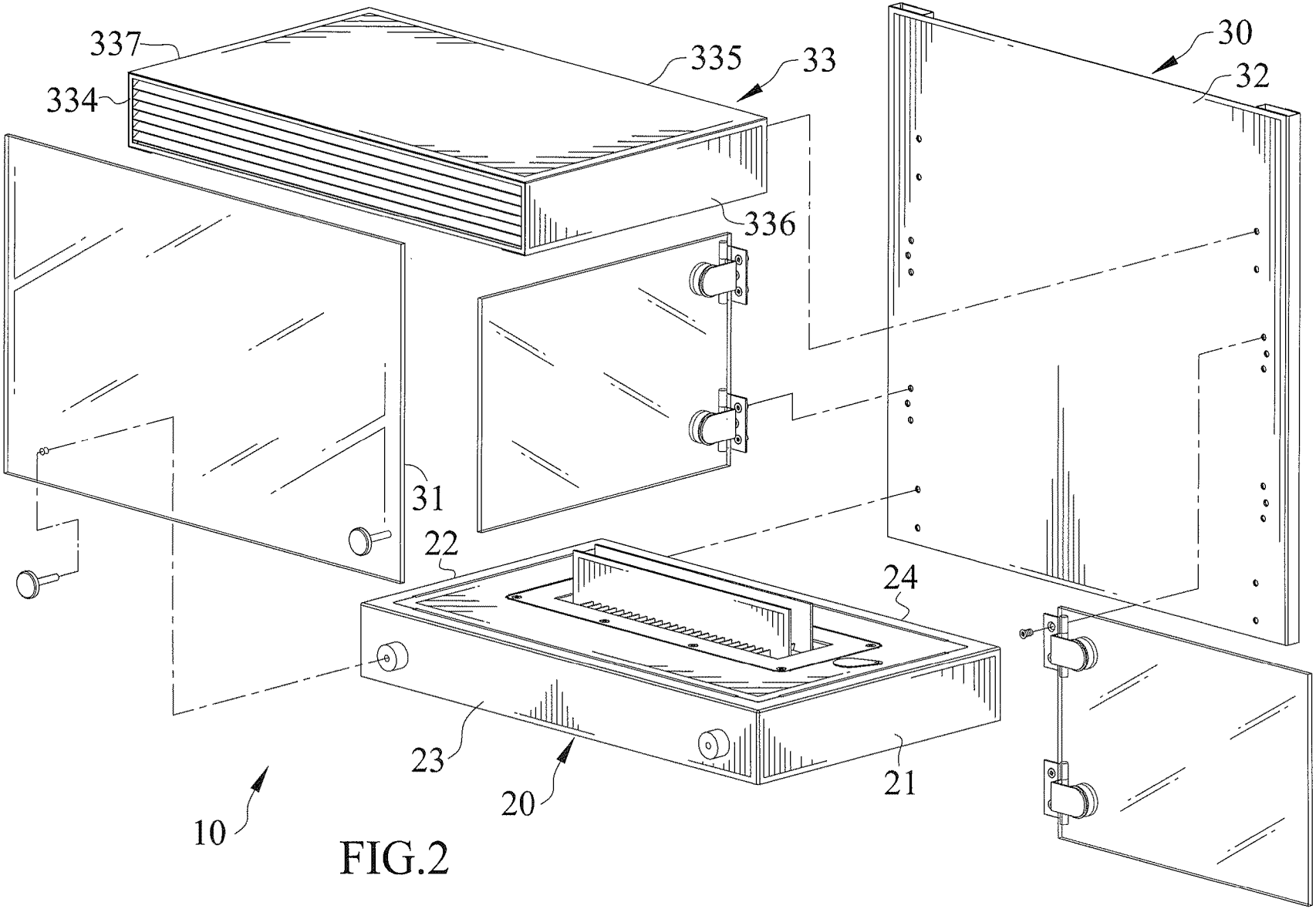
FIG. 2 is a partial, exploded perspective view of the smokeless safe combustion device of FIG. 1.
Figure 3:
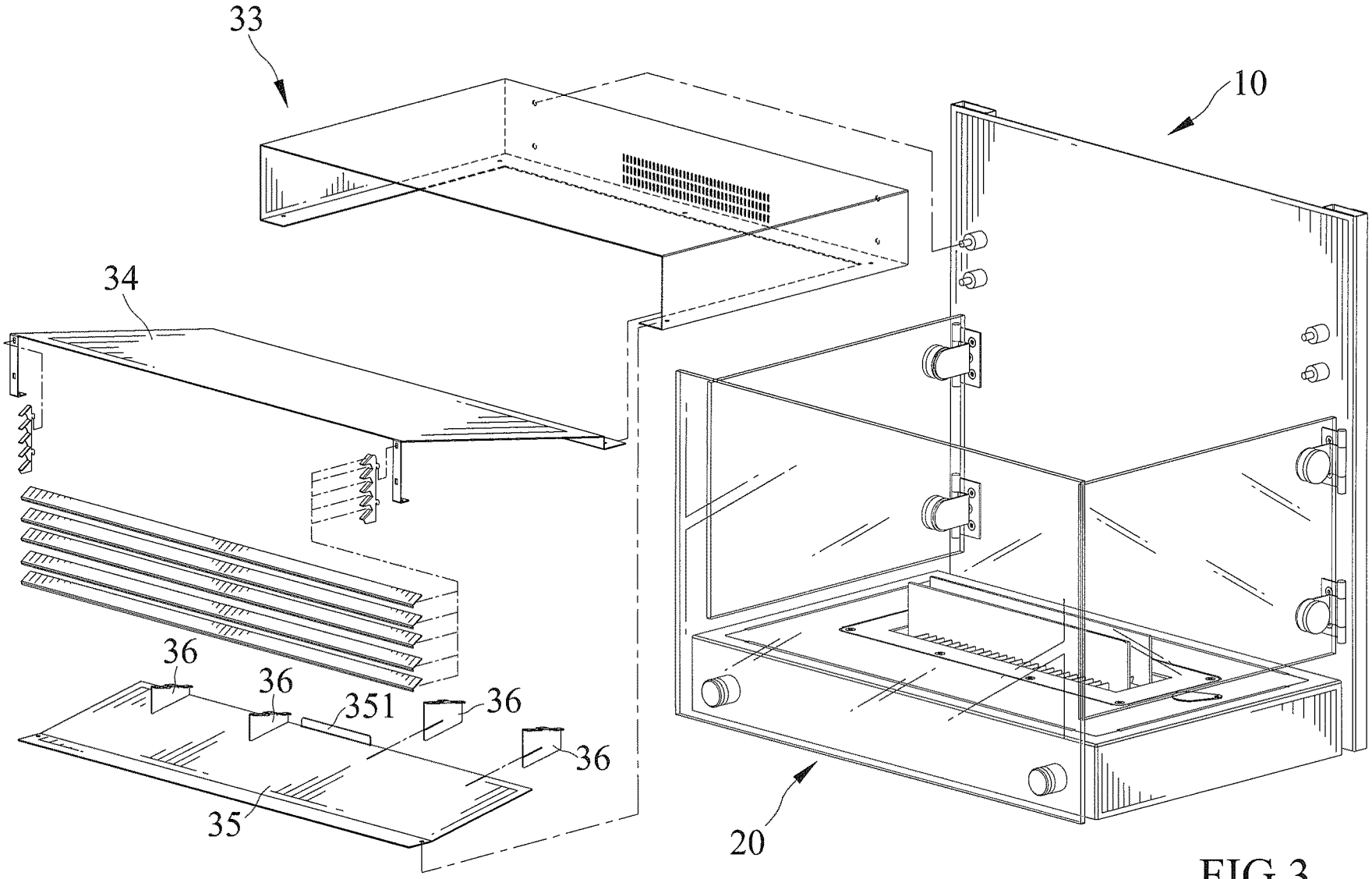
FIG. 3 is another partial, exploded perspective view of the smokeless safe combustion device of FIG. 1.
Figure 4:
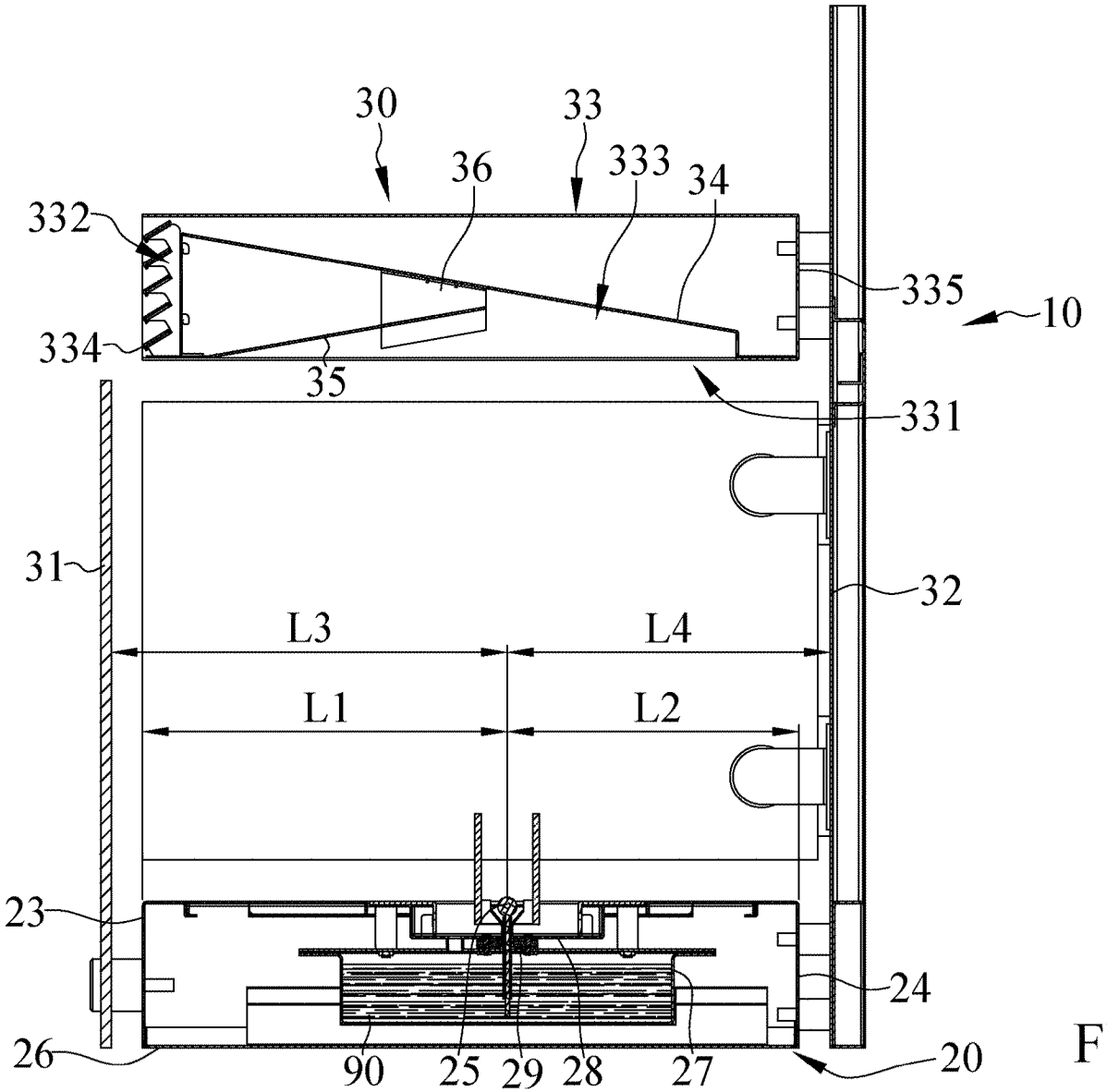
FIG. 4 is a cross-sectional view of the smokeless safe combustion device of FIG. 1.
Figure 5:
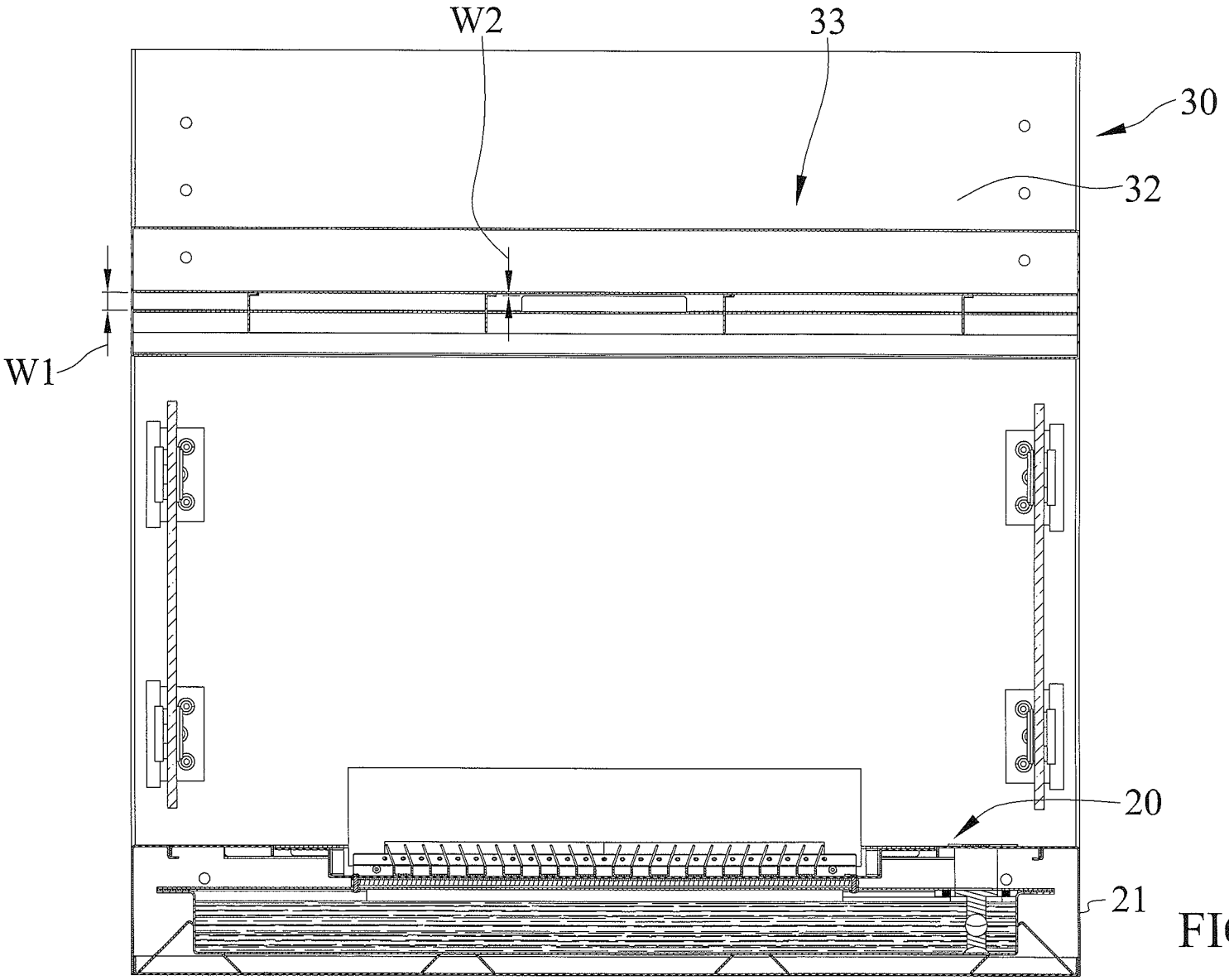
FIG. 5 is another cross-sectional view of the smokeless safe combustion device of FIG. 1.
Figure 6:
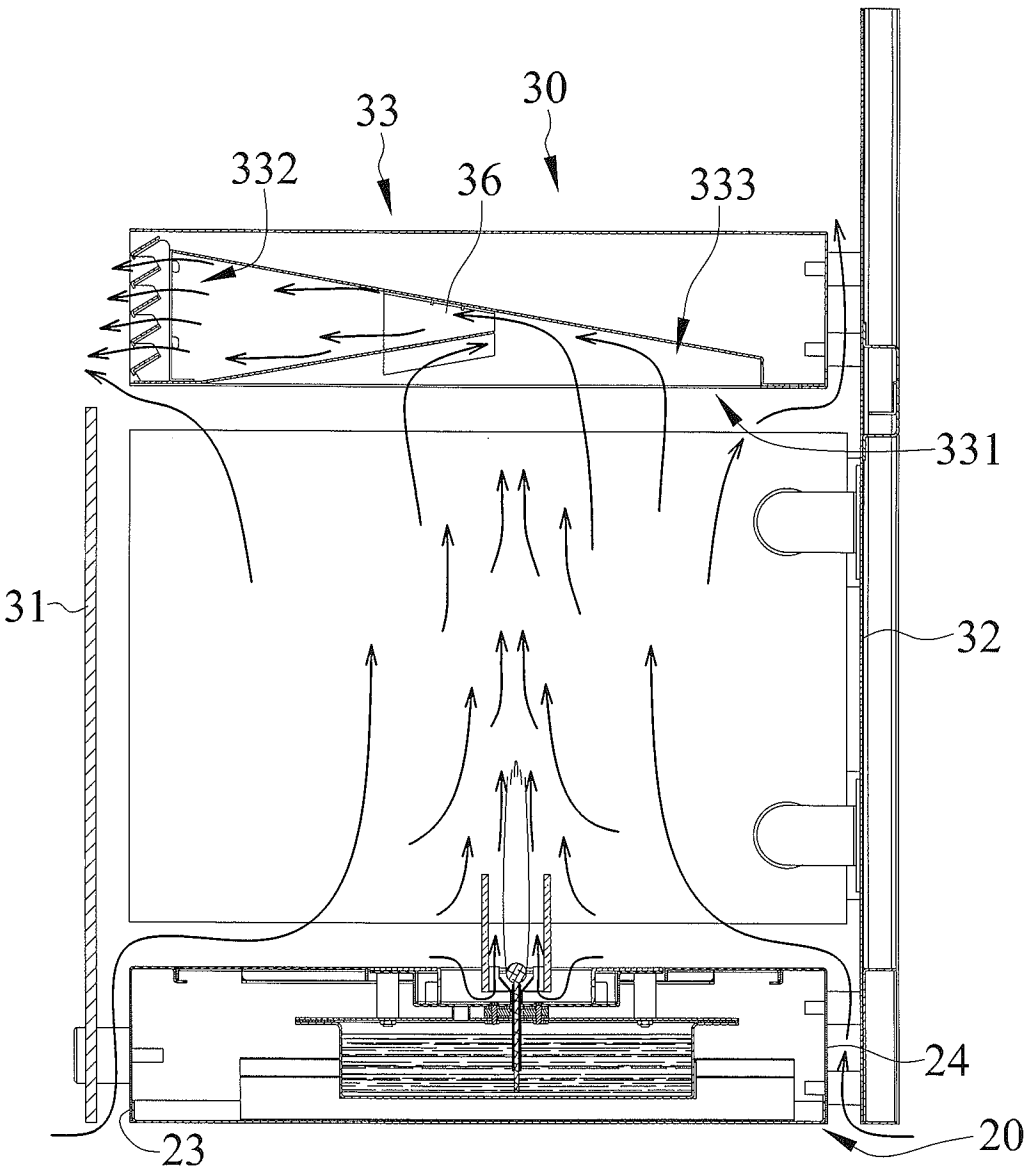
FIG. 6 is a cross-sectional view similar to FIG. 4 showing the smokeless safe combustion device of FIG. 1 in use, with arrows indicating heat flow directions.
Figure 7:
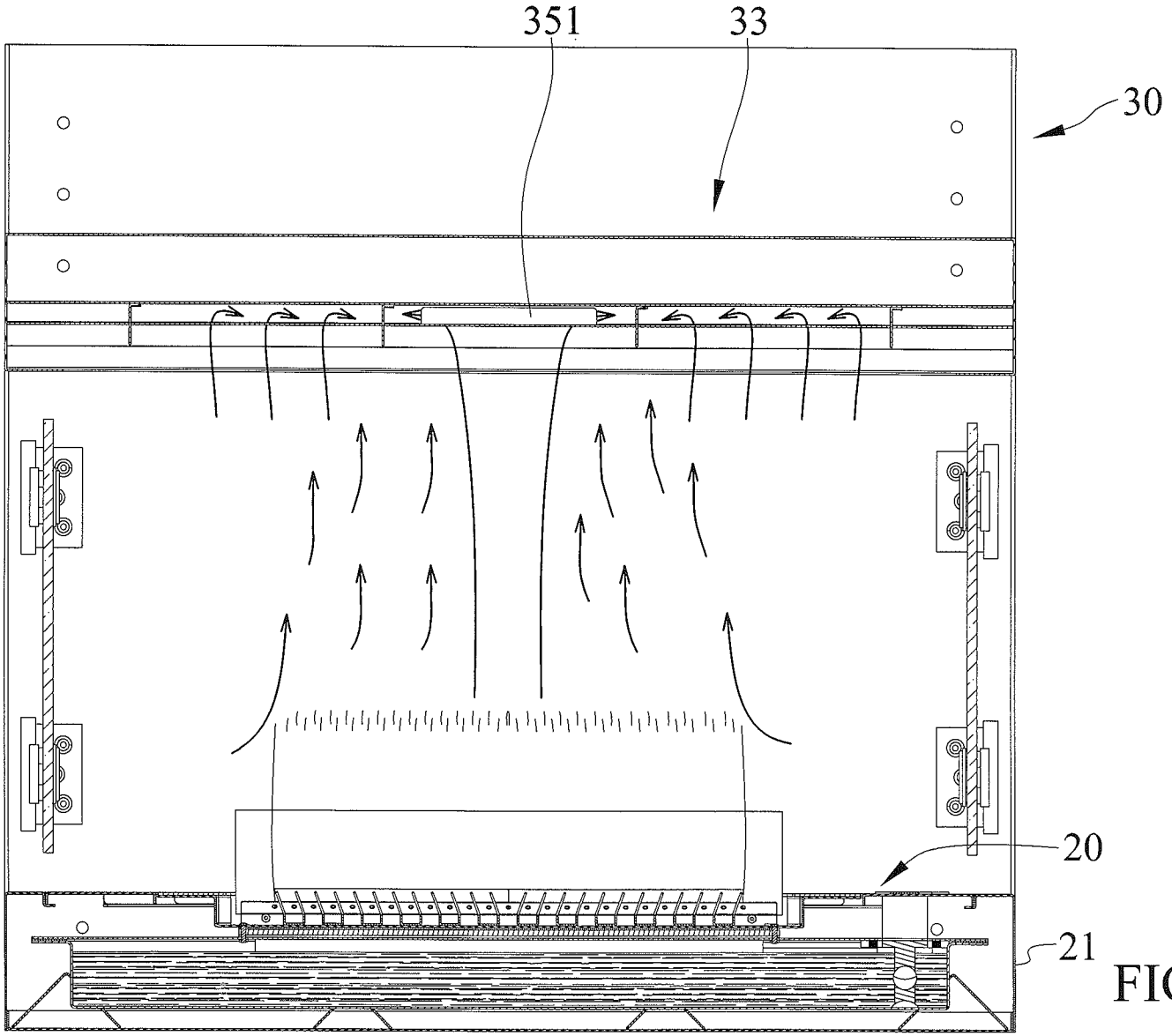
FIG. 7 is a cross-sectional view similar to FIG. 5 showing the smokeless safe combustion device of FIG. 1 in use, with arrows indicating heat flow directions.

FIGS. 1 through 7 show a smokeless safe combustion device 10 in accordance with the present invention. The smokeless safe combustion device 10 includes a stove body 20 and a flow guiding device 30.

The stove body 20 includes an outer container 26 defining a cavity, a fuel reservoir 27 disposed in the cavity, and a fuel tray 28 disposed vertically above and separately from the fuel reservoir 27. The stove body 20 has sides 21 and 22 disposed oppositely and sides 23 and 24 disposed oppositely. The sides 21, 22, 23, and 24 are sides of the outer container 26. The fuel reservoir 27 defines a reservoir space configured for storing fuel 90. The fuel reservoir 27 is disposed in the cavity. The fuel reservoir 27 has outer peripheries spaced from adjacent inner peripheries of the outer container 26.

The stove body 20 includes a wick 25 disposed between the sides 23 and 24. The wick 25 has a height extending from its upper end to its lower end. The wick 25 has a greater width at its upper end than its lower end. The wick 25 is spaced from the sides 23 and 24 at first and second distances L1 and L2, respectively. The wick 25 has a lower end disposed in a reservoir space defined by the fuel reservoir 27. The stove body 20 further includes two shields disposed parallel to one another. The wick 25 is disposed between and spaced from the two shields. The upper end of the wick 25 has a length extending parallel to the shields. Each of the shields includes a top end located outside of the fuel tray 28 and a bottom end located within and spaced from a bottom side of the fuel tray 28. The upper end of the wick 25 is at a lower height than the top ends of the shields.

Further, a thermal insulating device 29 interconnects the fuel reservoir 27 and the fuel tray 28. The thermal insulating device 29 prevents heat transfer between the fuel reservoir 27 and the fuel tray 28. The thermal insulating device 29 has two opposite lateral sides, and the wick 25 extends through the thermal insulating device 29 and is disposed between the two lateral sides. The thermal insulating device 29 has two opposite lateral sides. The wick 25 extends through the thermal insulating device 29 and is disposed between the two lateral sides.

The thermal insulating device 29 includes two thermal insulating members and a fixture for supporting the thermal insulating members between the fuel reservoir 27 and the fuel tray 28. Each of the two thermal insulating members has two opposite lateral sides, and the wick 25 extends through the two thermal insulating members and is disposed between the two lateral sides thereof. One of the thermal insulating members is abutted against an outer surface of the fuel reservoir 27 and another thermal insulating member is abutted against an outer surface of the fuel tray 28 respectively. The fixture is disposed between the two thermal insulating members. The fixture includes at least one fixing plate and at least one fastener. The at least one fixing plate is made of metal. The fuel reservoir 27, the at least one fixing plate, and the fuel tray 28 respectively include an engaging hole for engaging with the at least one fastener. The at least one fixing plate is disposed between the two thermal insulating members, and one of the two thermal insulating members is secured to the fuel reservoir 27 by engaging the at least one fastener with the engaging holes of the fuel reservoir 27 and the at least one fixing plate while another thermal insulating member is secured to the fuel tray 28 by engaging the at least one fastener with the engaging holes of the fuel tray 28 and the at least one fixing plate. The two thermal insulating members and the at least one fixing plate are in a form of a plate and extend parallel to one another. The at least one fixing plate includes two fixing plates. The two fixing plates are disposed adjacent to one another with a space therebetween, and the wick 25 is disposed between the two fixing plates and extends through the space.

The flow guiding device 30 includes a first and second shielding member 31 and 32 respectively connected to the sides 23 and 24 of the stove body 20. The first shielding member 31 is a glass. The second shielding member 32 is a glass, or a mount, or a wall of a room. The wick 25 is spaced from the first and second shielding members 31 and 32 at third and fourth distances L3 and L4 respectively. The third distance L3 is greater than the first distance L1 and the first shielding member 31 is spaced from the side 23. The fourth distance L4 is greater than the second distance L2 and the second shielding member 32 is spaced from the side 24.

The flow guiding device 30 includes a heat extracting apparatus 33 disposed vertically above and outside of and spaced from the stove body 20. The flow guiding device 30 has an inlet port 331 on a side thereof adjacent to the stove body 20, an outlet port 332 on another side, and a passage 333 having an inlet and outlet end respectively communicating with the inlet and outlet ports 331 and 332. The heat extracting apparatus 33 has ends 334 and 335 disposed oppositely and lateral edges 336 and 337 disposed oppositely and extending between the ends 334 and 335. The end 335 of the heat extracting apparatus 33 is connected to the second shielding member 32. The outlet port 332 is located at the end 334 of the heat extracting apparatus 33. The heat extracting apparatus 33 includes a first flow guiding member 34 and a second flow guiding member 35 cooperating with the first flow guiding member 34 to form the passage 333. The first flow guiding member 34 is disposed vertically above and spaced from the second flow guiding member 35. The first flow guiding member 34 includes a surface bounding an upper part of the passage 333. The surface of the first flow guiding member 34 is sloped upward from an end adjacent to the end 335 of the heat extracting apparatus 33 to an end adjacent to the end 334 of the heat extracting apparatus 33. The second flow guiding member 35 includes a surface bounding a lower part of the passage 333. The surface of the second flow guiding member 35 is sloped downward from an end adjacent to and spaced from the surface of the first flow guiding member 34 to an end adjacent to the first end 334 of the heat extracting apparatus 33. The passage 333 includes a narrowed section defined between the surface of the first flow guiding member 34 and the end of the surface of the second flow guiding member 35 which is adjacent to and spaced from the surface of the first flow guiding member 34. The passage 333 is flared from the narrowed section to the outlet end. The end of the surface of the first flow guiding member 34 which is adjacent to the second end 335 of the heat extracting apparatus 33 is at a lower height than the end which is adjacent to the end 334 of the heat extracting apparatus 33. The end of the surface of the second flow guiding member 35 which is adjacent to the surface of the first flow guiding member 34 is at a higher height than the end which is adjacent to the end 334 of the heat extracting apparatus 33. The first and second flow guiding members 34 and 35 are disposed between the lateral edges 336 and 337 of the heat extracting apparatus 33. The inlet port 331 defines an opening greater than an opening of the narrowed section. The passage 333 tapers toward its narrowed section in a vertical direction. The passage is flared from its narrowed section to the outlet end in a horizontal direction.

The heat extracting apparatus 33 also includes at least one third flow guiding member 36 extending in a vertical direction and connected between the first and second flow guiding members 34 and 35. The at least one third flow guiding member 36 is disposed adjacent to the narrowed section of the passage 333. The at least one third flow guiding member 36 can direct the heat flowing in the passage 333. The at least one third flow guiding member 36 includes a portion extending between the first and second flow guiding members 34 and 35 and above the second flow guiding member 35. The at least one third flow guiding member 36 includes a portion extending below the second flow guiding member 35. The at least one third flow guiding member 36 includes four third flow guiding members 36. The four third flow guiding members 36 are disposed in a spaced relationship between the lateral edges 336 and 337 of the heat extracting apparatus 33.

The heat extracting apparatus 33 further includes a projection 351 disposed vertically above the surface of the second flow guiding member 35. The end of the surface of the second flow guiding member 35 which is adjacent to and spaced from the surface of the first flow guiding member is spaced from the surface of the first flow guiding member 34 at a distance which defines a first width W1. The projection 351 is spaced from the surface of the first flow guiding member 34 at a distance which defines a second width W2. The second width W2 is smaller than the first width W1. The projection 351 is located between and spaced from two of the third flow guiding members 36.

In the operation of the smokeless safe combustion device 10, the wick 25 is lit. When the wick 25 is lit, it consumes the fuel 90 in the fuel reservoir 27 and generates a flame and heat.

In view of the foregoing, the fuel tray 28 is disposed above and separately from the fuel reservoir 27, thereby preventing heat from transferring to the fuel reservoir 27 when the wick 25 is ignited. Moreover, the thermal insulating device 29 prevents the heat from transferring to fuel reservoir 27. Therefore, the fuel 90 in the fuel reservoir 27 is at a relatively low temperature, and a user can operate the combustion device 10 more safely.

Further, when the fuel 90 is burned, air adjacent to the wick 25 is heated and rises and creates a current drawing in cold air. Cold air can be admitted through spaces between the first shielding member 31 and the outer container 26 and between the second shielding member 32 and the outer container 26 respectively and flow toward the wick 25. The heated air is disposed near the wick 25 and is away from the first and second shielding members 31 and 32. Therefore, each of the first and second shielding members 31 and 32 is at a relatively low temperature and prevents burning the user inadvertently and damaging the material of the wall or the paint thereon.

Furthermore, the heated air is admitted efficiently into the inlet port 331 by the first and second shielding members 31 and 32. The heated air is concentrated toward the center of the inlet port 331 by the first and second flow guiding members 34 and 35, too.

Furthermore, when the heated air flows in the passage 333, it is diverted toward the lateral edges 336 and 337 by the projection 351. In addition, the heated air is guided by the third flow guiding members 36 to flow out of the flow guiding device 30 through the outlet port 332 evenly and smoothly. Therefore, heat is delivered uniformly to the room.

The foregoing is merely illustrative of the principles of this invention, and various modifications can be made by those skilled in the art without departing from the scope and spirit of the invention.

What is claimed is:

1. A combustion device comprising:

a stove body having a periphery including first and second sides disposed oppositely and including a wick disposed between the first and second sides, with the wick spaced from the first and second sides at first and second distances respectively; and a flow guiding device including a first shielding member and a second shielding member respectively connected to the first and second sides of the stove body, wherein the wick is spaced from the first and second shielding members at third and fourth distances respectively, wherein the third distance is greater than the first distance and the first shielding member is spaced from the first side, and wherein the fourth distance is greater than the second distance and the second shielding member is spaced from the second side, wherein the flow guiding device has an inlet port on a side thereof adjacent to the stove body, an outlet port on another side, and a passage having an inlet and outlet end respectively communicating with the inlet and outlet ports, and wherein the flow guiding device includes a heat extracting apparatus disposed vertically above and outside of and spaced from the stove body; and wherein the heat extracting apparatus has first and second ends disposed oppositely and first and second lateral edges disposed oppositely and extending between the first end and the second end, wherein the outlet port is located at the first end of the heat extracting apparatus, wherein the heat extracting apparatus includes a first flow guiding member and a second flow guiding member cooperating with the first flow guiding member to form the passage, with the first flow guiding member disposed vertically above and spaced from the second flow guiding member, wherein the first flow guiding member includes a surface bounding an upper part of the passage, with the surface being sloped upward from an end adjacent to the second end of the heat extracting apparatus to an end adjacent to the first end of the heat extracting apparatus, wherein the second flow guiding member includes a surface bounding a lower part of the passage, with the surface of the second flow guiding member being sloped downward from an end adjacent to and spaced from the surface of the first flow guiding member to an end adjacent to the first end of the heat extracting apparatus, wherein the passage includes a narrowed section defined between the surface of the first flow guiding member and the end of the surface of the second flow guiding member which is adjacent to the surface of the first flow guiding member, wherein the passage is flared from the narrowed section to the outlet end, wherein the heat extracting apparatus includes at least one third flow guiding member extending in a vertical direction and connected between the first and second flow guiding members, wherein the at least one third flow guiding member is disposed adjacent to the narrowed section, wherein the at least one third flow guiding member includes a portion extending between the first and second flow guiding members and above the second flow guiding member, wherein the at least one third flow guiding member includes a portion extending below the second flow guiding member, wherein the heat extracting apparatus includes a projection disposed vertically above from the surface of the second flow guiding member, wherein the end of the surface of the second flow guiding member which is adjacent to the surface of the first flow guiding member is spaced from the surface of the first flow guiding member at a distance which defines a first width, wherein the projection is spaced from the surface of the first flow guiding member at a distance which defines a second width, wherein the second width is smaller than the first width, wherein the at least one third flow guiding member includes two third flow guiding members spaced from one another, and wherein the projection is located between and spaced from the two third flow guiding members.

2. The combustion device as claimed in claim 1, wherein the inlet port defines an opening greater than an opening of the narrowed section of the passage, wherein the passage tapers toward its narrowed section in the vertical direction, and wherein the passage is flared from its narrowed section to the outlet end in a horizontal direction.

3. The combustion device as claimed in claim 1, wherein the first shielding member is a glass, and wherein the second shielding member is a glass, or a mount, or a wall of a room.

4. The combustion device as claimed in claim 1, wherein the second end of the heat extracting apparatus is connected to the second shielding member.

5. The combustion device as claimed in claim 1, further comprising a fuel reservoir and a fuel tray disposed vertically above and separately from the fuel reservoir, and wherein the wick has a lower end disposed in a reservoir space defined by the fuel reservoir.

6. The combustion device as claimed in claim 5, wherein the stove body includes an outer container defining a cavity and the fuel reservoir is disposed in the cavity, and wherein the first and second sides of the stove body are first and second sides of the outer container.

7. The combustion device as claimed in claim 5, further including a thermal insulating element interconnecting the fuel reservoir and the fuel tray.

8. The combustion device as claimed in claim 7, wherein the thermal insulating element has two opposite lateral sides, and wherein the wick extends through the thermal insulating element and is disposed between the two lateral sides.

9. The combustion device as claimed in claim 6, wherein outer peripheries of the fuel reservoir are spaced from adjacent inner peripheries of the outer container.

10. The combustion device as claimed in claim 5, wherein the wick has an upper end and a height extending from the upper end to the lower end, and wherein the wick has a greater width at the upper end than the lower end.

11. The combustion device as claimed in claim 10, wherein the stove body includes two shields disposed parallel to one another, wherein the wick is disposed between and spaced from the two shields, wherein the upper end of the wick has a length extending parallel to the two shields, wherein each of the shields includes a top end located outside of the fuel tray and a bottom end located within and spaced from a bottom side of the fuel tray, and wherein the upper end of the wick is at a lower height than the top ends of the shields.

* * * * *